US009411348B2

(12) United States Patent
Iacob et al.

(10) Patent No.: US 9,411,348 B2
(45) **Date of Patent: *Aug. 9, 2016**

(54) PROGRAMMABLE LOW-DROPOUT REGULATOR AND METHODS THEREFOR

(75) Inventors: Radu H. Iacob, Santa Clara, CA (US); Cornel D. Stanescu, Bucharest (RO); Adrian M. Tache, Bucharest (RO); Sabin A. Eftimie, Bucharest (RO)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 1181 days.

This patent is subject to a terminal disclaimer.

(21) Appl. No.: 12/759,541

(22) Filed: Apr. 13, 2010

(65) Prior Publication Data

US 2011/0248688 A1 Oct. 13, 2011

(51) Int. Cl.
*G05F 1/00* (2006.01)
*G05F 1/56* (2006.01)

(52) U.S. Cl.
CPC ..... *G05F 1/56* (2013.01)

(58) Field of Classification Search
CPC ..... G05F 1/56
USPC ..... 323/274, 283, 281, 349
See application file for complete search history.

(56) References Cited

U.S. PATENT DOCUMENTS

| | | | | |
|---|---|---|---|---|
| 5,334,928 | A | 8/1994 | Dobkin et al. | |
| 6,177,785 | B1 * | 1/2001 | Lee | 323/281 |
| 6,396,339 | B1 | 5/2002 | Jacobs | |
| 6,703,885 | B1 | 3/2004 | Fan et al. | |
| 7,218,168 | B1 | 5/2007 | Rahman | |
| 7,265,608 | B1 | 9/2007 | Lu et al. | |
| 7,400,123 | B1 * | 7/2008 | Voogel | 323/280 |
| 7,477,046 | B2 | 1/2009 | Eberlein | |
| 7,482,844 | B2 | 1/2009 | Brady et al. | |
| 7,531,996 | B2 | 5/2009 | Yang et al. | |
| 7,545,126 | B2 | 6/2009 | Su et al. | |
| 7,619,402 | B1 | 11/2009 | Kwong | |
| 7,834,600 | B2 | 11/2010 | Bassett et al. | |
| 7,964,992 | B2 | 6/2011 | Apfel | |
| 8,169,202 | B2 | 5/2012 | Chen | |
| 8,400,126 | B2 * | 3/2013 | Iacob et al. | 323/282 |
| 2006/0120163 | A1 | 6/2006 | Serrano et al. | |
| 2006/0261797 | A1 | 11/2006 | Man et al. | |
| 2007/0046271 | A1 | 3/2007 | Zolfaghari | |
| 2011/0187344 | A1 | 8/2011 | Iacob et al. | |
| 2011/0248688 | A1 | 10/2011 | Iacob et al. | |

OTHER PUBLICATIONS

Micrel Inc., Datasheets for MIC2826, Jul. 2009, Micrel Inc., pp. 1-27.*

(Continued)

*Primary Examiner* — Jue Zhang
(74) *Attorney, Agent, or Firm* — Polansky & Associates, P.L.L.C.

(57) ABSTRACT

A low-dropout (LDO) regulator includes a voltage reference circuit to provide a reference voltage, a pass device including an input terminal coupled to a voltage input, an output terminal to provide an output voltage and a control terminal, and an error amplifier including a first amplifier input for receiving the reference voltage, a second amplifier input, an amplifier output coupled to the control terminal of the pass device. Additionally, the LDO regulator includes a feedback circuit including a feedback input coupled to the output terminal of the pass device and a feedback output coupled to the second amplifier input to provide a feedback signal. The LDO regulator further includes a control circuit including a non-volatile memory to store configuration data to control operation of the voltage reference circuit, the pass device, the error amplifier, and the feedback circuit to produce the output voltage.

22 Claims, 9 Drawing Sheets

(56) References Cited

OTHER PUBLICATIONS

Stanescu, Cornel; Caracas, Cristi; Aungurencei, Gabriel; and Russell, Anthony, "Quick-Start CMOS Voltage Reference for Positive LDOS," CAS 2005 Proceedings, 2005 International Semiconductor Conference, Oct. 5, 2005, v. 2, pp. 379-382.

Stanescu, C.; Iacob, R.; Dinca, C.; Caracas, C.; Profirescu, O.; "0.5A fast CMOS LDO"; International Semiconductor Conference, 2009. CAS 2009, vol. 2, pp. 473-476.

Actions on the Merits for Copending U.S. Appl. No. 12/760,150, filed Apr. 14, 2010.

* cited by examiner

PROGRAMMABLE LOW-DROPOUT REGULATOR AND METHODS THEREFOR

CROSS-REFERENCE TO RELATED APPLICATION

Related subject matter is found in co-pending U.S. patent application Ser. No. 12/760,150 filed on Apr. 14, 2010, entitled "Floating-Gate Programmable Low-Dropout Regulator and Method Therefor," by Radu H. Iacob et al. and assigned to the assignee hereof.

FIELD

The present disclosure is generally related to low-dropout (LDO) regulators, and in particular to programmable LDOs and methods therefor.

BACKGROUND

Low-dropout (LDO) regulators are intended to provide a well-defined level of voltage supply for a wide range of operating conditions, including variable supply voltage, load current, temperature etc. Typically, such devices are not equipped with user-mode digitally programmable features. Conventionally, LDO regulators sometimes include one-time programmable means, which may be programmed using one-time programmable techniques, such as laser trimming or metal wire fuse melting during production testing.

Some LDO regulators include a control terminal that can be connected to ground or that can be supplied a certain voltage level in order to select a modified value of the nominal output voltage, providing limited programmability. Some other LDO regulators include a terminal or group of terminals that provide an irreversible one-time programmability function to adjust the level of the output voltage. However, such limited programmability does not account for the wide variety of applications that can employ a particular LDO regulator and does not address the needs of various end users.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of a programmable LDO regulator are disclosed below that include a digital trimming mechanism based on a binary control sequence that can be used to configure various circuit blocks within the LDO regulator, including a voltage reference circuit, a pass device, an error amplifier, and a feedback circuit. The binary control sequence can be stored in a non-volatile register of the LDO regulator, allowing for recovery of the programmed settings on power-up.

By incorporating the digital trimming mechanism within the programmable LDO regulator, the number of manufacturing masks required to implement various output voltage levels is reduced. Further, the digital trimming provides a reliable solution for adjusting functional parameters of the LDO regulator circuit during both front-end testing and back-end testing. Additionally, the digital trimming mechanism allows such parameters to be programmed multiple times, increasing the flexibility for handling inventories and reducing turn-around time for providing LDO regulator products to customers.

Further, the digital trimming mechanism includes a serial interface, which provides an end-user solution for changing or adjusting functional parameters of the LDO regulator. The serial interface provides a means for digital control of the LDO regulator's performance parameters, which allows easy functional interfacing with various control systems or easy functional integration within other circuitry, such as a power management integrated circuit (PMIC) system. Further, the serial interface allows for easy access to the user-programmable features of the LDO regulator.

Digital trimming techniques can be employed for adjusting DC and AC parameters related to the output voltage of the LDO regulator. For example, digital trimming techniques can be used to change the output voltage level, such as by selecting the nominal value from a range of predetermined levels. Alternatively or in addition, such digital trimming techniques can be applied to adjust the output voltage to provide enhanced precision. Further, digital trimming can be used to adjust one or more impedances to optimize the AC performance. In one instance, a control circuit includes a non-volatile data storage medium for storing a digital sequence of signals to control functional features and performance parameters of the LDO regulator. Using a digital sequence to control parameters of the programmable LDO regulator makes it possible to program the LDO regulator multiple times, as compared to one-time programmable laser trimming or electrical techniques for melting fuses. Additionally, digital programmability of the DC and AC parameters can be used both for production testing purposes and for providing user-mode trimming capabilities.

Figure 1:
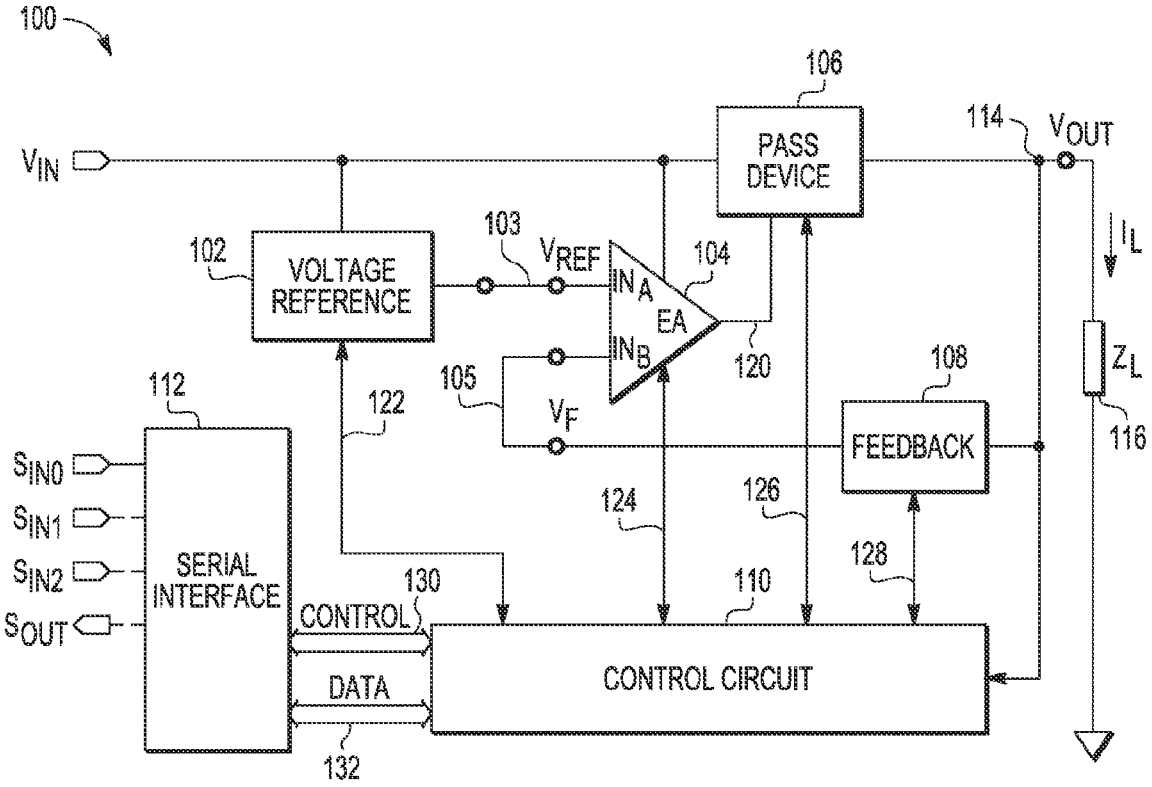
FIG. 1 is a partial schematic and partial block diagram of an embodiment of a programmable low-dropout (LDO) regulator circuit.

FIG. 1 is a partial schematic and partial block diagram of an embodiment of a low-dropout (LDO) regulator circuit 100 including a control circuit 110. LDO regulator circuit 100 includes a voltage input ($V_{IN}$) coupled to a programmable voltage reference circuit 102, which is configured to provide a reference voltage ($V_{REF}$) to an output terminal 103. Output terminal 103 is connected to a first input of a programmable error amplifier 104. Programmable error amplifier 104 further includes a second input coupled to a programmable feedback circuit 108 to receive a feedback signal ($V_F$) and includes an amplifier output connected to a control input of a programmable pass device 106.

Programmable pass device 106 includes a first input connected to the voltage input ($V_{IN}$) and an output terminal 114 configured to carry an output voltage ($V_{OUT}$) and a load current ($I_L$). Programmable pass device 106 provides power from the voltage input ($V_{IN}$) to a load 116, generally indicated as a load impedance ($Z_L$).

In the illustrated embodiment, control circuit 110 is connected to programmable voltage reference 102 via reference control input 122 to provide one or more control signals to selectively adjust a thermal coefficient of the reference voltage. Control circuit 110 is also connected to programmable error amplifier 104 to provide a control signal via error control input 124 to adjust an adaptive bias parameter, a short-circuit protection parameter and/or an offset parameter. In a first mode, the bias parameter is disabled to apply a fixed bias having a pre-defined level to control a quiescent current flowing through the error amplifier 104. In a second mode, the bias parameter is enabled to apply an adaptive bias configured to automatically adjust a quiescent current flowing through the error amplifier 104 based on the load current ($I_L$). Additionally, the short-circuit protection parameter can be configured using one or more control signals received via control input 124 to adjust a level for providing such protection, which is triggered in response to the load current ($I_L$). Moreover, a DC offset parameter can be configured by control signals on control input 124 to adjust the input offset of the error amplifier. Also, an AC frequency compensation mechanism can be enabled using control signals on control input 124.

Further, control circuit 110 is connected to programmable pass device 106 via pass device control input 126 to selectively enable or disable circuitry within programmable pass device 106 to control the load current ($I_L$). In an example, programmable pass device 106 includes a transistor network that is configurable to program a transient response. Additionally, control circuit 110 is connected to programmable feedback circuit 108 via feedback control input 128 to selectively adjust the impedance of programmable feedback circuit 108. The programmable feedback circuit 108 can include a Resistor-Capacitor (RC) network that is programmable to provide a desired complex impedance. Further, the programmable feedback circuit 108 can also include a resistive network that is programmable to provide a desired resistance. Programmable feedback circuit 108 provides the ability to adjust a DC output voltage level as well as AC performance parameters of the LDO regulator circuit 100.

In the illustrated embodiment of FIG. 1, programmable LDO regulator 100 is equipped with a serial interface 112 for receiving instructions from an external source and for exchanging data with the external source. Serial interface 112 can be custom one-wire, two-wire or three-wire serial interface. Alternatively, serial interface 112 can be a standard $I^2C$ bus interface, a serial peripheral interface (SPI), a micro-wire serial bus interface, a universal serial bus interface, another serial interface, or some combination thereof. The external source may be a microcontroller, a microprocessor, a Power Management Integrated Circuit (PMIC), a system on a chip (SOC) circuit, another type of circuit, or any combination thereof. Serial interface 112 is connected to control circuit 110 to send and receive control information 130 and other data 132 from and to the external source.

In addition to the digital signals sent through the serial interface 112, other external signals may be applied to LDO regulator circuit 102 during a programming cycle, in order to provide the programming voltage level ($V_{PP}$) required for a tunneling process in floating-gate MOS devices. The information programmed through the tunneling process can be retained on the floating-gate even when the devices are not powered, and can be erased or reprogrammed by applying programming signals, such as a signal with the required voltage level to initiate the electric charge tunneling to or from the floating-gate. In one implementation, the programming signal including ($V_{PP}$) is provided through the serial interface 112. In another implementation, ($V_{PP}$) can be generated internally using an on-chip charge-pump (not shown). The floating-gate MOS devices can be implemented using electrically-erasable programmable read only memory (EEPROM) technology, CMOS technology, Bi-CMOS and other MOS technologies.

In an embodiment, various features of the programmable error amplifier 104 can be enabled or disabled by digital control signals from control circuit 110. One of the representative features is the adaptive bias versus fixed bias of the error amplifier 104. The adaptive bias increases the quiescent current of the error amplifier 104 with the increasing current load ($I_L$) through the programmable pass device 106, thus providing a faster transient response. However, such a feature increases the power consumption and decreases the DC efficiency of the LDO regulator circuit 100. Since power consumption and DC efficiency may be significant in certain application, the ability to disable the adaptive bias feature and to limit the quiescent current of the error amplifier 104 to a certain maximum value may be useful in certain low-power applications. Such a control function can be implemented using a digital signal, which is programmable through the serial interface 112 and which is applied by control circuit 110.

Another feature of the error amplifier 104 that can be easily programmed using digital control signals is a short circuit protection parameter. Depending on the implementation, the digital control signals from control circuit 110 and/or from serial interface 112 can be used to choose a level of the load current ($I_L$) that triggers the short circuit protection, turning off pass device 106.

A programmable offset control mechanism can also be implemented using digital control signals in order to modify the DC offset of the error amplifier 104. Further, the AC performance of the error amplifier 104 can be modified using digital control signals that configure a frequency compensation mechanism 108, which works in conjunction with the error amplifier 104.

In operation, the LDO regulator circuit 100 has the ability to receive instructions and data via serial interface 112 for controlling the DC and AC performance parameters of the LDO regulator circuit 100. In this way, LDO regulator circuit 100 is considered to be digitally programmable. In some embodiments, it may be desirable to store the configuration parameters in a memory. Control circuit 110 can include volatile data storage, such as a register, a cache, or other volatile memory. An example of an embodiment of control circuit 110, including both volatile and non-volatile registers, is depicted in FIG. 2.

Figure 2:
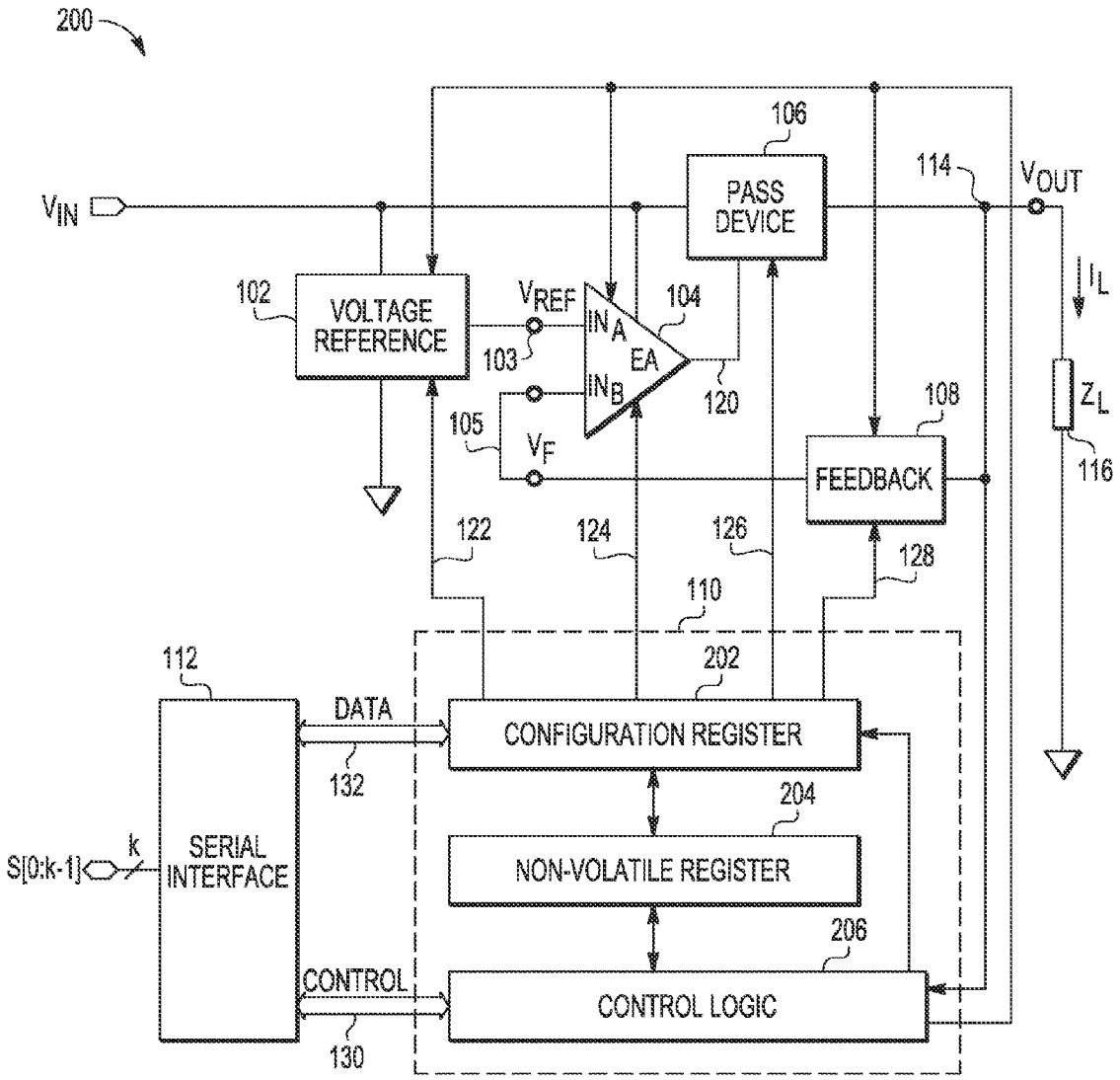
FIG. 2 is a partial schematic and partial block diagram of the programmable LDO regulator circuit of FIG. 1 with an expanded view of an embodiment of a control block.

FIG. 2 is a partial schematic and partial block diagram of an embodiment of an LDO regulator circuit 200, such as the LDO regulator circuit 100 of FIG. 1, with an expanded view of an embodiment of the control circuit 110. In the illustrated embodiment, control circuit 110 includes a volatile configuration register 202, a non-volatile register 204, and control logic 206. Such volatile and non-volatile registers 202 and 204 can be used to store one or more digital sequences to control the programmable voltage reference 102, the programmable error amplifier 104, the programmable pass device 106, and the programmable feedback circuit 108.

In an example, control circuit 110 receives a digital control sequence from an external source through serial interface 112 and stores the digital control sequence in configuration register 202. The stored digital control sequence configures parameters of programmable voltage reference 102, programmable error amplifier 104, programmable pass device 106, and programmable feedback circuit 108, controlling DC and AC parameters associated with the output voltage. Once a desired performance of LDO regulator circuit 200 is achieved using the one or more digital sequences, control logic 206 stores the configuration data (such as the digital sequence) in non-volatile register 204. In the event of an unexpected power loss or when power is restored after a shut down event, control logic 206 can reload the configuration data from non-volatile register 204 into volatile configuration register 202 to configure operation of LDO regulator circuit 100.

The output voltage and associated AC and DC characteristics may be partially adjusted using programmable feedback circuit 108. Programmable feedback circuit 108 can be implemented in a variety of ways. Examples of representative embodiments of programmable feedback circuit 108 are depicted below in FIGS. 3-5.

Figure 3:
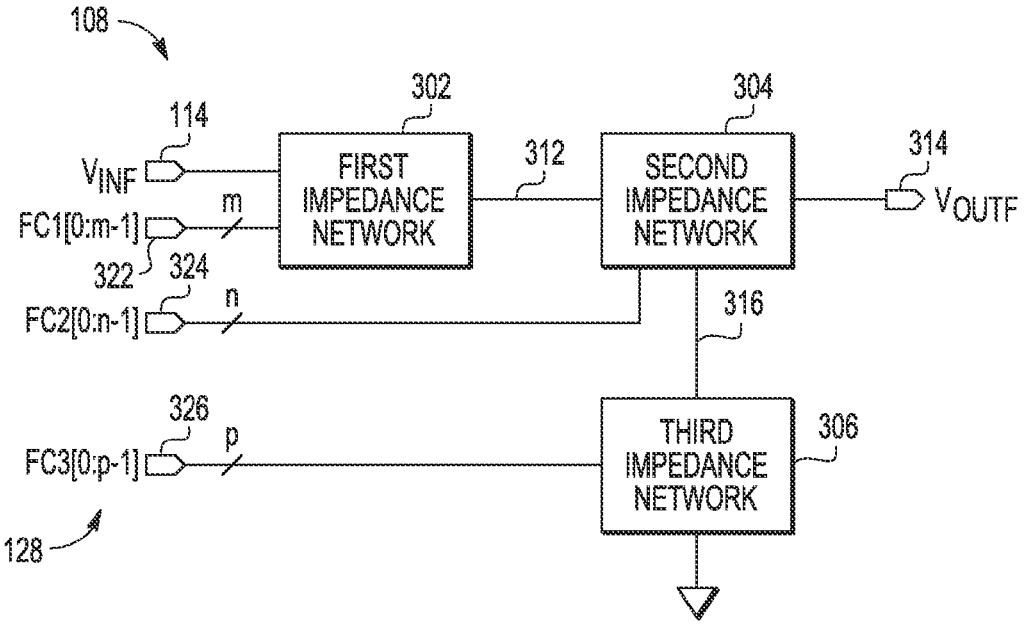
FIG. 3 is a block diagram of an embodiment of a feedback circuit of the LDO regulator of FIG. 1.

FIG. 3 is a block diagram of an embodiment of programmable feedback circuit 108 of the LDO regulator 100 of FIG. 1. Programmable feedback circuit 108 is a negative feedback network that includes a first impedance network (or input stage) 302 and second and third impedance networks (or output stages) 304 and 306. Each of the impedance networks 302, 304, and 306 are coupled to control circuit 110 via feedback control input 128, which includes first, second, and third feedback control inputs 322, 324, and 326. First impedance network 302 includes a feedback input coupled to output terminal 114 of LDO regulator circuit 100, feedback control input 322 to receive a first feedback control signal labeled "FC1[0:m−1]" from control circuit 110, and a terminal 312. Second impedance network 304 includes an input connected to terminal 312, a second feedback control input 324 for receiving a second feedback control signal labeled "FC2[0:n−1]" from control circuit 110, and a feedback output ($V_{OUTF}$) 314, which is connected to an input of error amplifier 104 depicted in FIG. 1. The second impedance network 304 also includes a terminal 316, which is connected to a third impedance network 306. Third impedance network 306 includes third feedback control input 326 to receive a third feedback control signal labeled "FC3[0:p−1]" from control circuit 110. Further, third impedance network 306 is connected to a power supply terminal, such as ground.

In operation, control circuit 110 is adapted to selectively configure at least one of the first, second, and third impedance networks 302, 304, and 306 to provide the desired impedance, thereby modifying a transfer function $T_v(s)$ of programmable feedback circuit 108. An example of one possible embodiment of the first impedance network 302 is depicted below in FIG. 4. Examples of another possible embodiment of the first impedance network 302 and of possible embodiments of the second and third impedance networks 304 and 306 are depicted below in FIG. 5.

Figure 4:
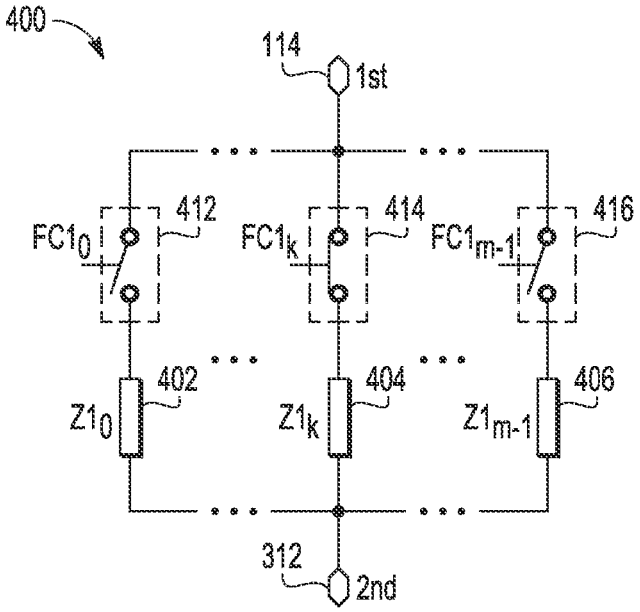
FIG. 4 is a partial schematic and partial block diagram of an embodiment of a first impedance network of the feedback circuit depicted in FIG. 3.

FIG. 4 is a partial schematic and a partial block diagram of a first embodiment of a first impedance network 400 of the feedback circuit 108, such as first impedance network 302 depicted in FIG. 3. First impedance network 400 includes a feedback input connected to the voltage output 114 and includes a terminal 312. First impedance network 400 further includes first impedance 402 including a first terminal connected to terminal 312 and a second terminal connected to the feedback input through a feedback control switch 412. First impedance network 400 also includes second impedance 404 including a first terminal connected to terminal 312 and a second terminal connected to the feedback input through a feedback control switch 414. Further, first impedance network 400 includes a third impedance 406 including a first terminal connected to terminal 312 and a second terminal connected to the feedback input through a feedback control switch 416.

In operation, control circuit 110 selectively activates one or more of the switches 412, 414, and 416 to selectively connect a respective one or more of the impedances 402, 404, and 406 in parallel to produce the desired impedance. While three impedances 402, 404, and 406, and associated switches 412, 414, and 416 are shown, it should be understood that any number of impedances and associated switches may be used to achieve the desired impedance. Further, it should be understood that each of the impedances 402, 404, and 406 can include a resistor, a capacitor, or both, and that control signals from controller 110 can be used to selectively connect one or more of impedances 402, 404, and 406 in parallel to produce the desired impedance.

Figure 5:
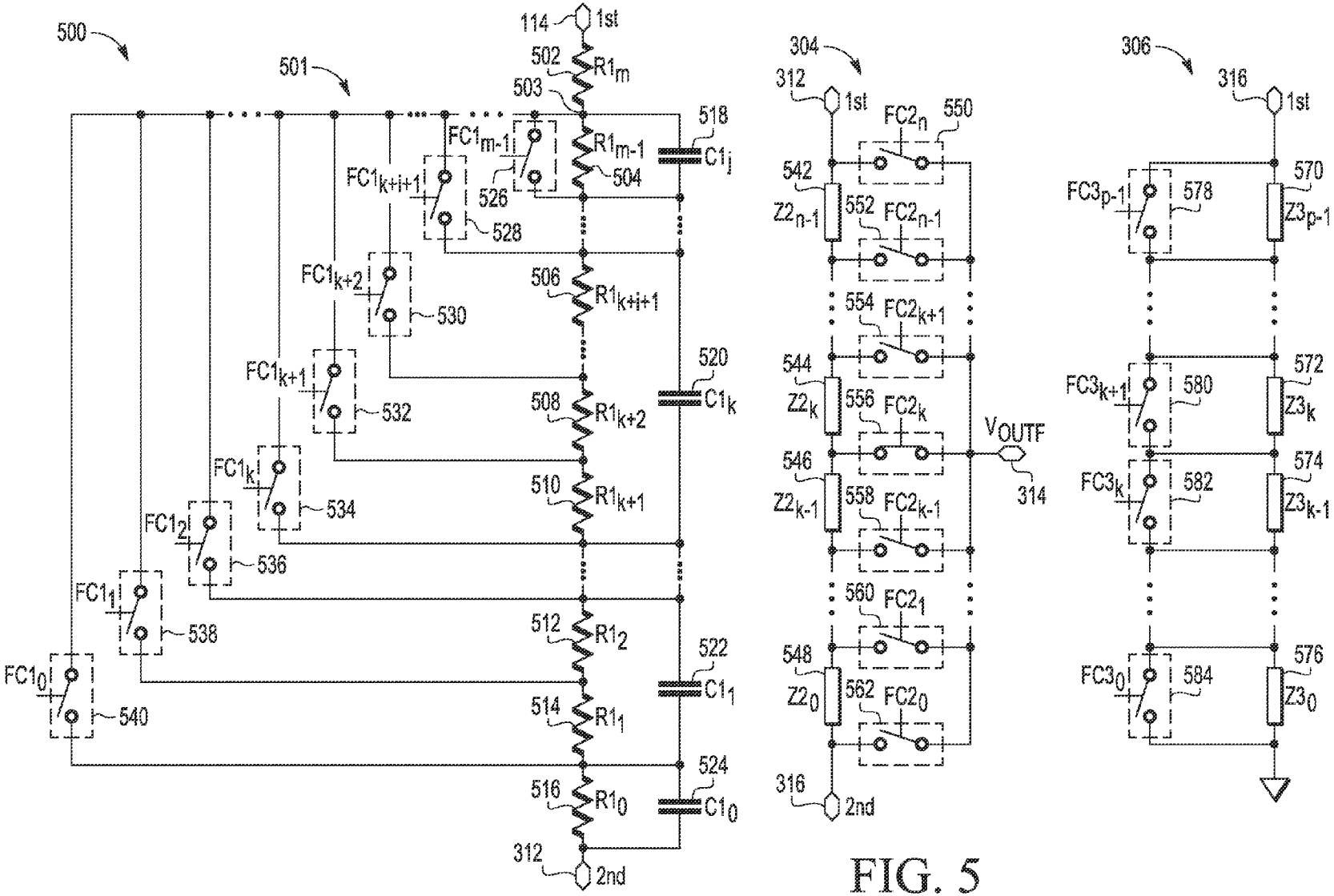
FIG. 5 is a schematic diagram of a second embodiment of the first impedance network and embodiments of second and third impedance networks of the feedback circuit depicted in FIG. 3.

FIG. 5 is a block diagram of a second embodiment of the first impedance network 501, such as first impedance network 302, and embodiments of second and third impedance networks 304 and 306 of the feedback circuit 108 depicted in FIG. 3. First impedance network 501 includes a feedback input connected to the voltage output 114 of LDO regulator circuit 100 depicted in FIG. 1 and includes terminal 312, which is connected to a feedback input of second impedance network 304. Second impedance network 304 includes a feedback output 314 and a second terminal 316. Third impedance network 306 includes a feedback input connected to second terminal 316 and a second terminal connected to ground.

In the illustrated embodiment of FIG. 5, first impedance network 501 includes resistors 502, 504, 506, 508, 510, 512, 514, and 516, capacitors 518, 520, 522, and 524, and switches 526, 528, 530, 532, 534, 536, 538, and 540. Resistor 502 includes a first terminal connected to the voltage output 114 and a second terminal connected to a node 503. Resistors 504, 506, 508, 510, 512, and 514 are connected in series between node 503 and terminal 312. Capacitor 518 is connected in parallel with resistor 504. Capacitor 520 is connected in parallel with resistors 506, 508, and 510. Capacitor 522 is connected in parallel with resistors 512 and 514. Capacitor 524 is connected in parallel with resistor 516.

Each of the switches 526, 528, 530, 532, 534, 536, and 538 includes a first terminal connected to node 503, a control terminal connected to control circuit 110, and a second terminal. The second terminal of switch 526 is connected to a second terminal of resistor 504. The second terminal of switch 528 is connected to a first terminal of resistor 506 in parallel with resistor 504 and one or more additional resistors and capacitors (not shown). The second terminal of switch 530 is connected to a node between resistors 506 and 508. The second terminal of switch 532 is connected to a node between resistors 508 and 510. The second terminal of switch 534 is connected to resistor 510 and in parallel with resistors 504, 506, 508, 510 and any intervening resistors and in parallel with capacitors 518, 520 and any intervening capacitors. The second terminal of switch 536 includes a first terminal connected to node 503 and a second terminal connected to resistor 512. Switch 538 includes a first terminal connected to node 503 and a second terminal connected to a node between resistors 512 and 514. Switch 540 includes a first terminal connected to node 503 and a second terminal connected to a node between resistors 514 and 516.

In operation, each of the switches 526, 528, 530, 532, 534, 536, 538, and 540 are configured to receive control signals from control circuit 110 to selectively bypass one or more of resistors 504, 506, 508, 510, 512, and 514 and capacitors 518, 520, and 522 to achieve the desired impedance.

Second impedance network 304 includes an input connected to terminal 312, a feedback output 314 connected to an input of error amplifier 104, and a terminal 316, which is connected to an input of third impedance network 306. Second impedance network 304 further includes a plurality of impedances 542, 544, 546, and 548 (and optionally other similar impedances not represented in FIG. 5), connected in series between terminal 312 and terminal 316. Additionally, second impedance network 304 includes a plurality of switches 550, 552, 554, 556, 558, and 560 (and optionally other similar switches, not represented in FIG. 5). Each of the plurality of switches 550, 552, 554, 556, and 558 includes a first electrode connected to feedback output 314, a control input connected to control circuit 110, and a second electrode. Switch 550 includes a second electrode connected to a node between terminal 312 and impedance 542. Switches 552 and 554 include second electrodes connected to different nodes between impedance 542 and impedance 544. Switch 556 includes a second electrode connected to a node between impedances 544 and 546. Switches 558 and 560 include second electrodes connected to different nodes between impedances 546 and 548. Switch 562 includes a second electrode connected to a node between impedance 548 and terminal 316.

In operation, control circuit 110 applies one or more second feedback control signals to the plurality of switches 550, 552, 554, 556, 558, 560, and 562 to selectively adjust the impedance between terminals 312 and 316 and between terminals 312 and 316 and the feedback output 314.

Third impedance network 306 includes an input connected to terminal 316 and an output connected to ground. Third impedance network 306 includes a plurality of impedances 570, 572, 574, and 576 connected in series between terminal 316 and ground. Third impedance network 306 further includes a plurality of switches 578, 580, 582, and 584, each of which is connected in parallel with a respective one of the plurality of impedances 570, 572, 574, and 576. Each of the plurality of switches 578, 580, 582, and 584 is responsive to control circuit 110 (depicted in FIG. 1) to selectively bypass a respective one or more of the impedances to control the effective impedance of third impedance network 306. In operation, control circuit 110 is configured to digitally program each of the first, second, and third impedance networks 501, 304, and 306 to provide the desired feedback impedance, which can be used to digitally trim the output voltage of LDO regulator 100.

An implementation of the digital trimming methodology on a 150 mA LDO regulator was manufactured in a non-volatile MOS technology. The circuit had a similar die-size to a conventional LDO regulator based on fuse melting trimming techniques, i.e., small enough to fit into a small outline transistor package, such as an SC-70 or other small outline package. In such an implementation having eight control bits for trimming the output voltage ($V_{OUT}$), the LDO regulator features programmable bits for configuring first impedance network 501 (or input stage of the feedback loop) and programmable bits for configuring the second and third impedance networks 304 and 306 (or output stage of the feedback loop) for high resolution adjustment. As previously discussed, the LDO regulator circuit 100 includes a non-volatile register (such as non-volatile register 204 in FIG. 2) for storing the control bits, which are used to configure the feedback circuit 108 to achieve the target output voltage value.

In a particular example, by controlling the impedance networks 501, 304, and 304, the DC output voltage of the LDO regulator can be finely adjusted in voltage steps of 10 mV. An initial spread of the output voltage ($V_{OUT}$) of 300 mV can be reduced to 100 mV after digital trimming. Further, a majority of the circuits can be adjusted in 10 mV increments to a target voltage within 20 mV of 2.5V. The distributions of values before and after trimming are represented in FIGS. 6 and 7, respectively.

Figure 6:
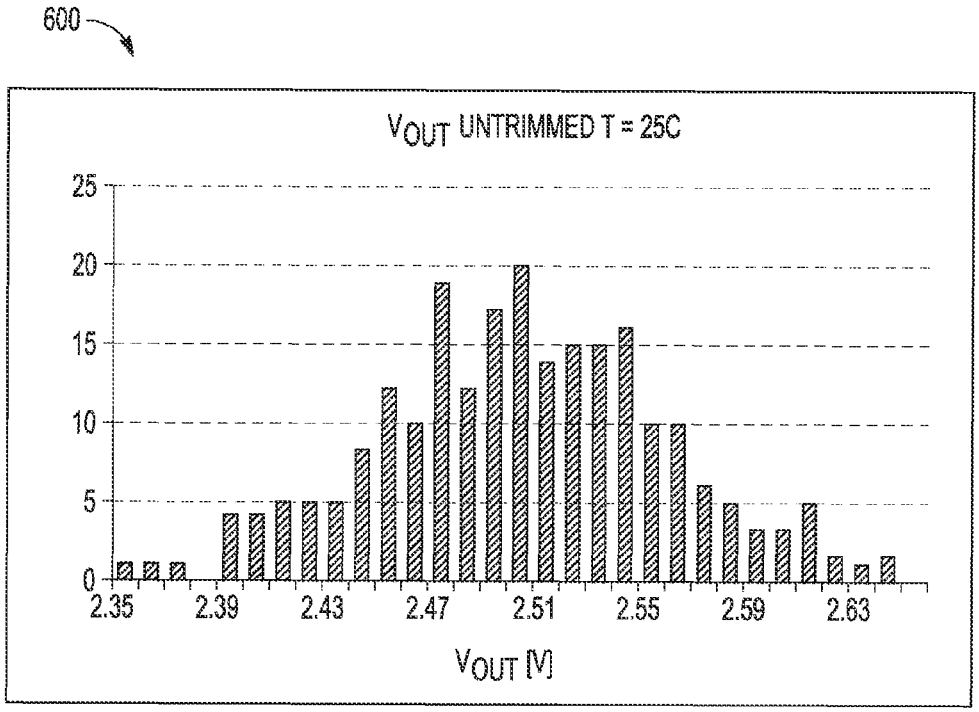
FIG. 6 is a diagram depicting output voltages of a number of tested parts before trimming using LDO regulator circuits, such as the LDO regulator circuit depicted in FIG. 1.

FIG. 6 is a diagram 600 depicting output voltages of a number of tested parts before trimming using LDO regulator circuits, such as the LDO regulator circuit 100 depicted in FIG. 1. Before trimming, the diagram 600 indicates that the output voltage ($V_{OUT}$) has a distribution over a range of values from about 2.35V to about 2.64V relative to a target voltage of about 2.5V.

Figure 7:
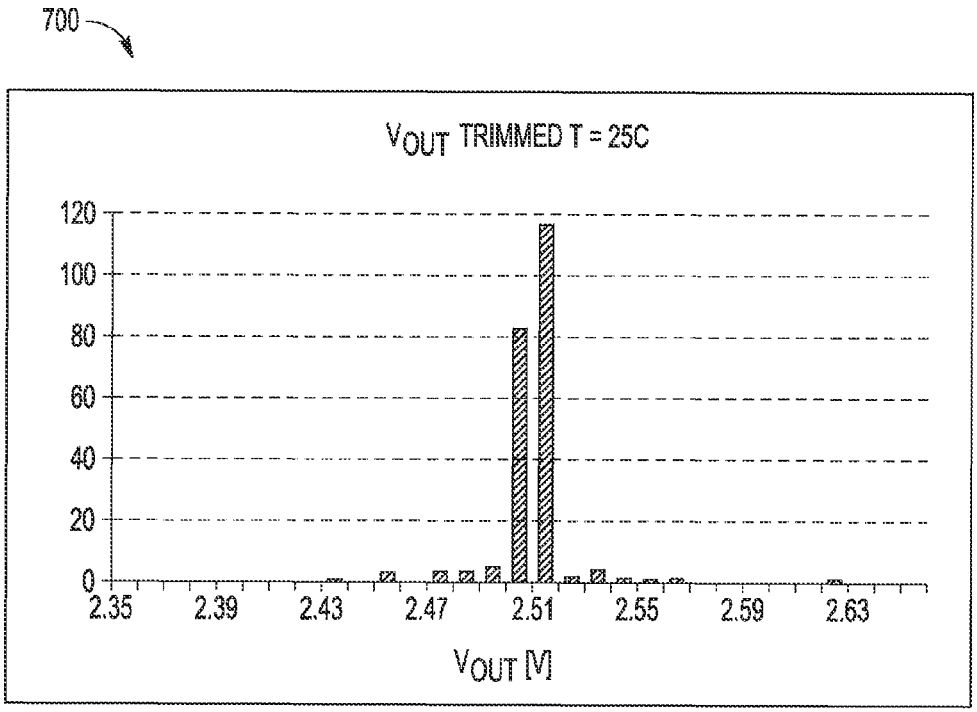
FIG. 7 is a diagram depicting output voltages of a number of tested parts after trimming using LDO regulator circuits, such as the LDO regulator circuit depicted in FIG. 1.

FIG. 7 is a diagram 700 depicting output voltages of a number of tested parts after trimming using LDO regulator circuits, such as the LDO regulator circuit 100 depicted in FIG. 1. In the illustrated diagram 700, a vast majority of the output voltages for the tested parts were within 20 mV of the 2.5V target.

Compared to the metal melting fuses technique, the digital trimming mechanism offers an advantage of flexible programming as many times as needed, at the wafer level and again after assembly. Such programmability eliminates offsets that may eventually occur after packaging and provides flexibility in setting the final configuration of the circuit.

While precision trimming of the output voltage level during the manufacturing test flow is one of the most important applications of the digital programmability in voltage regulators, user-mode programmability is also useful for efficient power management. For example, a portable radio transceiver could use various levels of output power for close range or long range transmission, thus mitigating the trade-off between the power consumption and the quality of communication. A battery power source could still be used in portable applications even when the battery power source is discharged below its nominal output value, by adjusting the LDO regulator 100 to a lower output voltage level, assuming that the application supports low-power low-voltage operation.

Digital trimming of the programmable feedback circuit also provides means for adjusting the frequency compensation mechanism of the LDO. Thus, considering a simplified model where the first impedance network is equivalent to an impedance consisting of a resistor $R_C$ and a capacitor $C_C$ connected in parallel, these components introduce a zero and a pole that contribute to the global stability of the LDO system. The zero is correlated to the produce $R_C C_C$, while the pole is correlated to the $C_C$ and the equivalent resistance as seen in the node 312 of the feedback network. When the first impedance is programmed, the configuration of the impedance network is changing, thus changing the values of $R_C$ and $C_C$ in the equivalent model, consequently adjusting the position of the zero and the pole introduced by $R_C$ and $C_C$ and modifying the AC behavior of the LDO.

In addition to programming the programmable feedback circuit 108, the voltage reference circuit 102 is also programmable. In particular, programmable voltage reference circuit 102 can provide a voltage-mode bandgap reference as depicted in FIG. 8 below or a current-mode bandgap reference as depicted below in FIG. 11.

Figure 8:
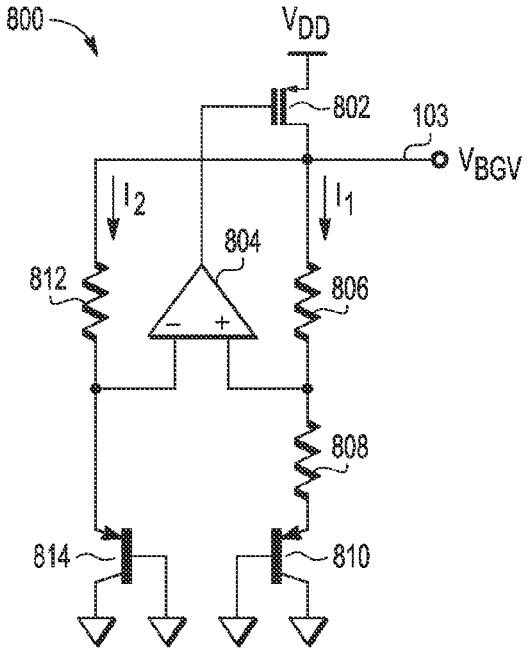
FIG. 8 is a schematic diagram of an embodiment of a voltage-mode bandgap reference circuit which is one possible implementation of the programmable voltage reference circuit depicted in FIG. 1.

FIG. 8 is a schematic diagram of an embodiment of a voltage-mode bandgap reference circuit 800, which is one possible implementation of the programmable voltage reference circuit 102 depicted in FIG. 1. The voltage-mode bandgap reference circuit includes a PMOS transistor 802 having a source electrode connected to a power supply terminal, a gate electrode, and a drain electrode connected to reference output 103 to provide a bandgap reference voltage ($V_{BGV}$). Further, the voltage-mode bandgap reference circuit includes an amplifier 804 having a first input connected to a first terminal of resistor 806, which has a second terminal connected to reference output 103. The first terminal of resistor 806 is also connected to a first terminal of resistor 808, which has a second terminal connected to an emitter electrode of a PNP bipolar junction transistor 810. Transistor 810 includes base and collector electrodes connected to ground.

Amplifier 804 further includes a second input connected to a first terminal of resistor 812, which has a second terminal connected to reference output 103. The first terminal of resistor 812 is connected to an emitter electrode of PNP bipolar junction transistor 814. Transistor 814 includes base and collector electrodes connected to ground.

In the illustrated embodiment, the temperature coefficient of the reference voltage ($V_{BGV}$) can be trimmed using digital signals from control circuit 110 to choose an appropriate ratio for the resistors. In particular, the bandgap reference voltage ($V_{BGV}$) on reference output 103 is related to base-emitter voltage ($V_{EB}$) of transistor 814 plus a temperature component, as indicated in Equation 1 below.

$$V_{BGV} = V_{EB814} + \frac{R_{812}}{R_{808}} V_T \ln\left(\frac{R_{806}}{R_{812}} * n\right) \tag{1}$$

In Equation 1, the variable ($V_T$) represents the thermal voltage of the circuit. The bandgap voltage ($V_{BGV}$) is related to the thermal voltage ($V_T$) and the ratio of the resistances. The bandgap voltage ($V_{BGV}$) may alternatively be determined based on the base-emitter voltage ($V_{EB}$) of transistor 810 plus a temperature component, as indicated in Equation 2 below:

$$V_{BGV} = V_{EB810} + \left(1 + \frac{R_{806}}{R_{808}}\right) V_T \ln\left(\frac{R_{806}}{R_{812}} * n\right) \tag{2}$$

Taking derivatives of both sides of Equation 1 results in Equation 3 below, which depicts the partial derivatives.

$$\frac{\partial V_{BGV}}{\partial T} = \frac{\partial V_{EB814}}{\partial T} + \frac{R_{812}}{R_{808}} V_T \ln\left(\frac{R_{806}}{R_{812}} * n\right) \frac{\partial V_T}{\partial T} \tag{3}$$

The factor $$\frac{\partial V_{EB814}}{\partial T}$$

represents a thermal variation of the voltage drop across the emitter-base forward biased junction of the PNP transistor 814. Thus, Equation 3 indicates that the thermal compensation of the bandgap voltage reference ($V_{BGV}$) can be adjusted by modifying the ratio of the resistors and the ratio of the emitters' area of the bipolar transistors. Considering a typical thermal variation of $$\frac{\partial V_{EB814}}{\partial T} = -2 \text{ mV/° K}$$

and a thermal variation of $$\frac{\partial V_T}{\partial T} = +0.085 \text{ mV/° K}$$

at T=300 degrees Kelvin, the resistance values of resistors 806, 808, and 812 and the ratio n of the emitters' area can be chosen (or programmed) such that the partial derivative of the bandgap voltage as a function of temperature is reduced to approximately zero, as shown below in Equation 4.

$$\left.\frac{\partial V_{BGV}}{\partial T}\right|_{T=300°K} = 0 \tag{4}$$

Thus, implementing programmable reference circuit 102 as a bandgap voltage reference circuit, as depicted in FIG. 8, achieves a first order thermal compensation.

While the resistor values could be adjusted or fixed during manufacturing, another technique uses programmable resistive networks or programmable floating-gate transistors to program the resistance of the programmable voltage regulator circuit. One possible example of a programmable resistive network, which may be used with the programmable voltage reference circuit 102 of FIG. 1, is depicted in FIG. 9.

Figure 9:
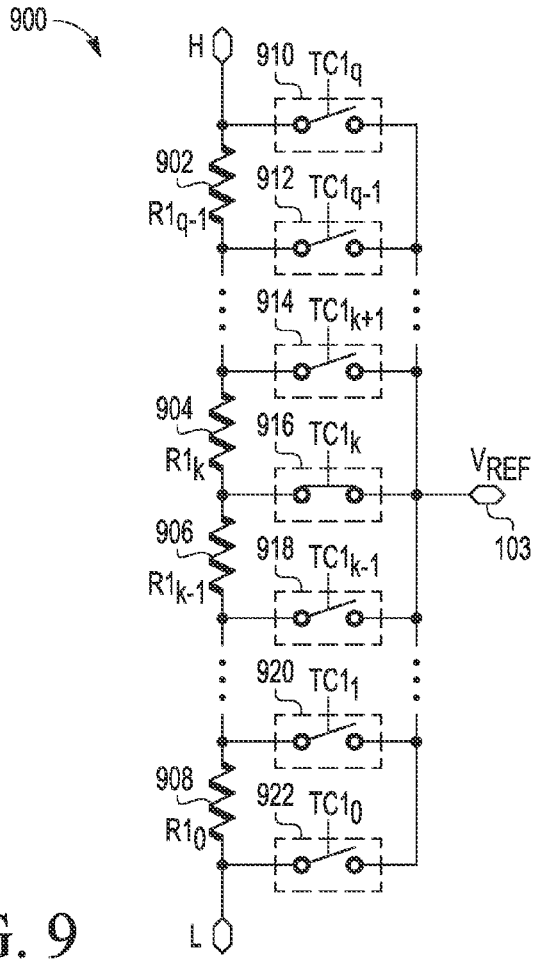
FIG. 9 is a schematic diagram of an embodiment of a programmable resistive network for use with the voltage-mode bandgap reference circuit of FIG. 8.

FIG. 9 is a schematic diagram of an embodiment of a resistive network 900, which may be used in place of resistor 812 within the voltage-mode bandgap reference circuit of FIG. 8. Resistive network 900 includes a plurality of resistors 902, 904, 906, and 908 connected in series. Further, resistive network 900 includes a plurality of switches 910, 912, 914, 916, 918, 920, and 922, each of which has a first current electrode connected between two of the resistors and a second current electrode connected to reference output 103. Each of the plurality of switches 910, 912, 914, 916, 918, 920, and 922 is independently configurable by control circuit 110 to selectively connect the reference output 103 into the interconnecting nodes between the resistors 902, 904, 906, and 908 through at least one of the plurality of switches 910, 912, 914, 916, 918, 920, and 922, thus implementing a programmable mechanism for adjusting the variation with temperature of the reference voltage ($V_{REF}$).

In general, the compensation temperature $T_C$ where the thermal coefficient of the reference voltage is zero is chosen at the middle of the operating temperatures range, in order to minimize the variation across all practical temperatures. One example of the thermal compensation of the reference voltage is illustrated in FIG. 10, which shows that the first order thermal compensation provided by resistive network 900 works at different temperatures and at different reference voltages.

Figure 10:
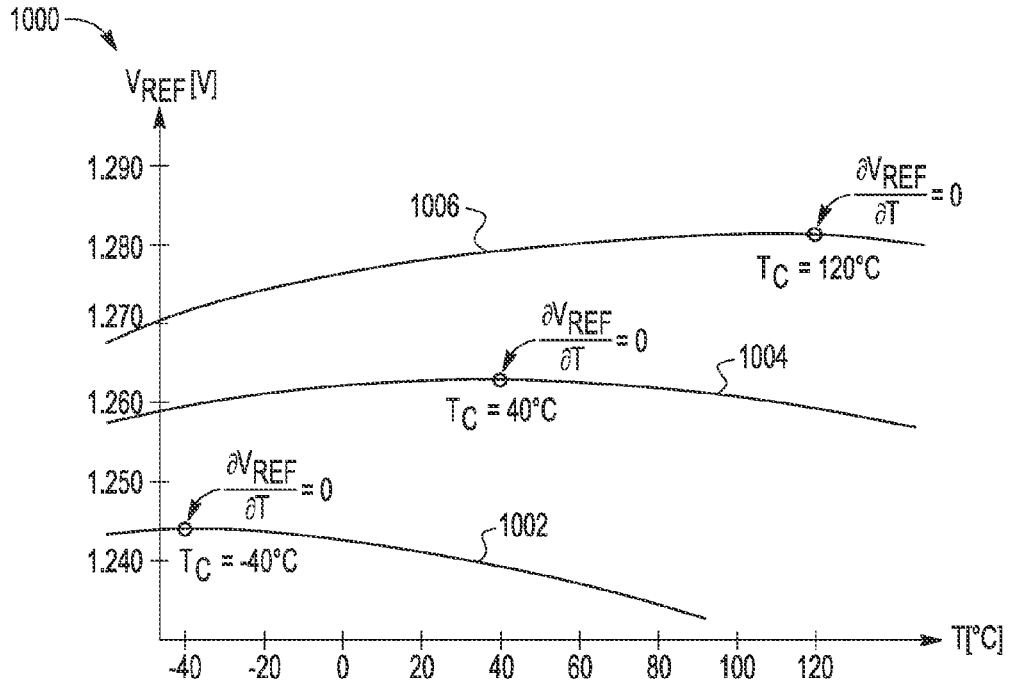
FIG. 10 is a diagram depicting thermal compensation of the reference voltage for various resistance values of the resistors of the voltage-mode bandgap reference circuit of FIG. 8.

FIG. 10 is a diagram 1000 depicting thermal compensation of the reference voltage for various values of resistance of the voltage-mode bandgap reference circuit of FIG. 8. Diagram 1000 shows a first line 1002 indicating a first order compensation of the reference voltage at approximately −40 degrees Celsius. Diagram 1000 further depicts a second line 1004 indicating a first order compensation of the reference voltage at approximately 40 degrees Celsius. Line 1006 indicates a first order compensation of the reference voltage at approximately 120 degrees Celsius. As depicted in FIG. 10, by programming the resistive network depicted in FIG. 9, the thermal compensation can be adjusted such that the programmable reference voltage circuit 102 produces a reference voltage that has a desired thermal coefficient and that is compensated, at least in a first order, for a desired operating parameter.

While the embodiment of the programmable voltage reference circuit 102 depicted in FIG. 8 provides a voltage-mode bandgap reference, it may sometimes be desirable to implement the programmable reference voltage circuit 102 as a current-mode bandgap reference. The current-mode bandgap reference architecture has the ability to preserve functional performance at voltage supply levels that are lower compared to those required by the voltage-mode architectures, yielding conveniently low level reference voltages by sourcing a reference current on a resistor. A similar digital trimming technique can be applied for adjusting the thermal coefficient of the reference voltage generated by a current-mode bandgap reference. One possible example of such a current-mode bandgap reference implementation of the programmable reference voltage circuit 102 is depicted in FIG. 11.

Figure 11:
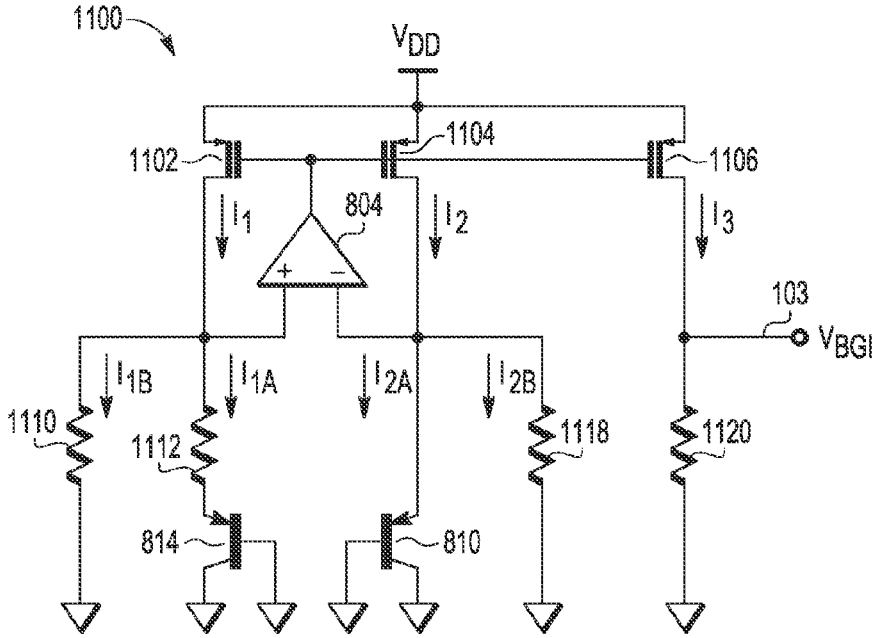
FIG. 11 is a schematic diagram of an embodiment of a current-mode voltage reference circuit, which is a possible implementation of the programmable voltage reference circuit depicted in FIG. 1.

FIG. 11 is a schematic diagram of an embodiment of a current-mode voltage reference circuit 1100, which is another possible implementation of the programmable voltage reference circuit 102 depicted in FIG. 1. Current mode reference circuit 1100 includes PMOS transistors 1102, 1104, and 1106 having common source electrodes connected to a voltage supply terminal ($V_{DD}$) and having common gate electrodes. A drain electrode of PMOS transistor 1102 is connected to a first input of amplifier 804 and is connected to ground through resistor 1110 and through resistor 1112 in series with PNP transistor 814. A drain electrode of PMOS transistor 1104 is connected to a second input of amplifier 804 and is connected to ground through resistor 1118 and through PNP transistor 810. A drain electrode of PMOS transistor 1106 is connected to reference output 103 and connected to ground through resistor 1120.

In operation, when a first current ($I_1$) on the drain electrode of PMOS transistor 1102 equals a second current ($I_2$) on the drain electrode of PMOS transistor 1104 and when resistors 1110 and 1118 are substantially equal, the bandgap reference voltage ($V_{BGI}$) produced by sourcing current ($I_3$) on resistor 1120 can be expressed according to Equation 5 below.

$$V_{BGI} = \frac{R_{1120}}{R_{1118}}\left(V_{EB810} + \frac{R_{1118}}{R_{1112}} V_T \ln n\right) \tag{5}$$

Further, taking a derivative of both sides of Equation 5 reveals that first order temperature compensation is achieved as shown in Equation 6.

$$\frac{\partial V_{BGI}}{\partial T} = \frac{R_{1120}}{R_{1118}}\left[\frac{\partial V_{EB810}}{\partial T} + \frac{R_{1118}}{R_{1112}} \ln\left(\frac{R_{1110}}{R_{1118}} * n\right)\frac{\partial V_T}{\partial T}\right] \tag{6}$$

In an alternative embodiment, additional resistors may be provided between the inputs to amplifier 804 and the drains of PMOS transistors 1102 and 1104. In an example, the additional resistors may be part of resistance networks, which are responsive to control signals from control circuit 110 to provide an adjustable resistance. Additionally, any or all of the resistors 1110, 1112, 1118, and 1120 (or any other resistors, not shown) may be implemented as switchable resistance networks.

In some instances, it may be desirable provide a quick-start option for producing the reference voltage ($V_{REF}$) quickly. In particular, sometimes capacitors may be used to reduce output noise by placing a capacitor on the $V_{REF}$ output. In such an instance, the capacitor should be charged quickly to allow for the quick-start option. However, low currents are preferred for operating the voltage reference in a low-power environment, and increasing the current sourced at the output of the reference circuit can result in exceeding the maximum allowed current consumption. It is still possible to provide such quick-start functionality without altering the bias currents of the current-mode reference. An example of such a circuit is described below with respect to FIG. 12.

Figure 12:
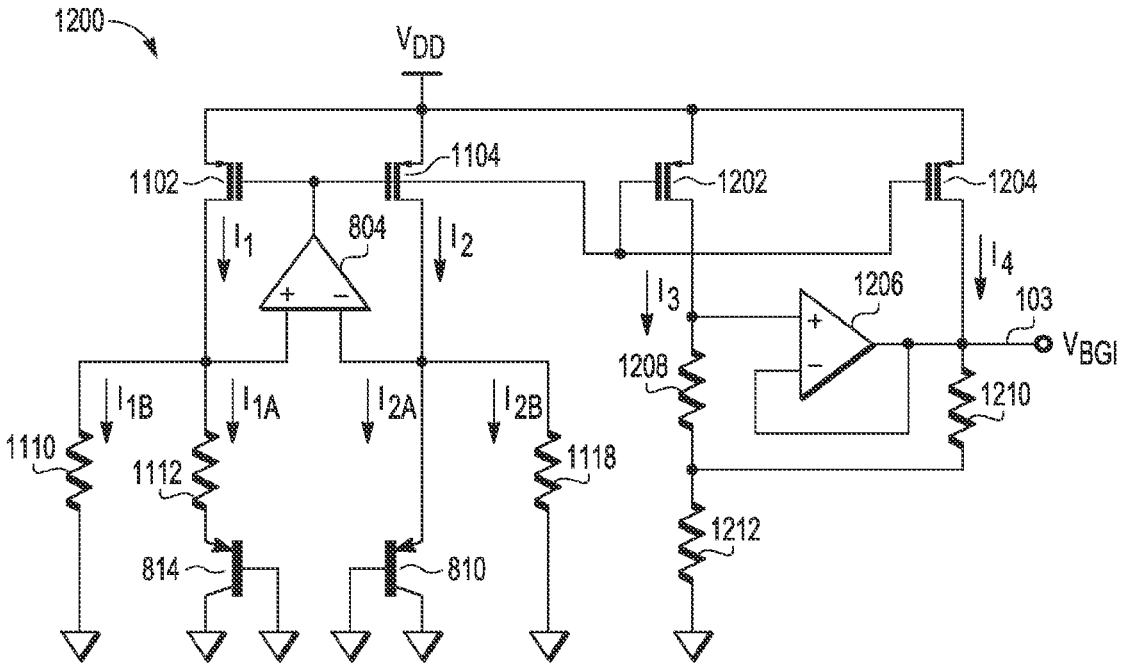
FIG. 12 is a schematic diagram of a second embodiment of a current-mode voltage reference circuit, which is another possible implementation of the programmable voltage reference circuit depicted in FIG. 1.

FIG. 12 is a schematic diagram of a second embodiment of a current-mode voltage reference circuit 1200, which is another possible implementation of the programmable voltage reference circuit 102 depicted in FIG. 1. Circuit 1200 is similar to circuit 1100 in FIG. 11, except that PMOS transistor 1106 and resistor 1120 are omitted. Circuit 1200 provides both a fast start-up time and an increased output current capability.

Circuit 1200 includes PMOS transistors 1202 and 1204 having common sources and gates that are connected to the source and gate, respectively, of PMOS transistor 1104. Circuit 1200 further includes an amplifier 1206, which has a positive input connected to a drain of transistor 1202, an amplifier output 103, and a negative input connected to amplifier output 103. Transistor 1204 includes a drain connected to amplifier output 103 and to a first terminal of resistor 1210, which has a second terminal. Circuit 1200 further includes a resistor 1208 having a first terminal connected to the positive input of amplifier 1206 and a second terminal connected to the second terminal of resistor 1210 and to a first terminal of resistor 1212, which has a second terminal connected to ground. The value of resistor 1208 is marginally lower than the value of resistor 1210, such that an operating voltage across resistor 1208 plus the input voltage offset of amplifier 1206 is lower than the operating voltage across resistor 1210. In this example, the operating voltage is the steady-state voltage after power-up. In this example, resistor 1212 has a much lower resistance than resistors 1208 and 1210. In particular, the resistance of resistor 1212 is only a percentage of the resistance of resistors 1208 and 1210. Further, the amplifier 1206 sources current, but does not sink current.

As compared to circuit 1100, circuit 1200 has two current branches on the output stage, corresponding to transistors 1202 and 1204. The current flow through transistors 1202 and 1204 is controllable based on the sizing of transistors 1202 and 1204 relative to each other and relative to transistors 1102 and 1104. Amplifier 1206 operates to drive the voltage at amplifier output 103 to provide a quick-start option. Once the reference voltage ($V_{BGI}$) at amplifier output 103 matches a voltage at the positive input of amplifier 1206, amplifier 1206 no longer provides the quick-start current. Further, amplifier 1206 cooperates with transistors 1202 and 1204, and resistors 1208, 1210 and 1212 to adjust the reference voltage ($V_{REF}$) without changing the temperature coefficient.

In the embodiment of FIGS. 11 and 12 and in Equations 5 and 6, resistances of resistors 1110 and 1118 can be chosen to achieve first order thermal compensation. Further, in an embodiment, resistors 1110 and 1118 can be implemented as resistive networks. Further, resistors 1210 and 1212 in FIG. 12 may also be implemented as resistive networks, providing a method for adjusting the voltage quickly without incurring a change in a temperature coefficient of the voltage reference circuit. One possible example out of many possible implementations of such a resistive network that can be programmed to achieve a desired resistance is illustrated below with respect to FIG. 13.

Figure 13:
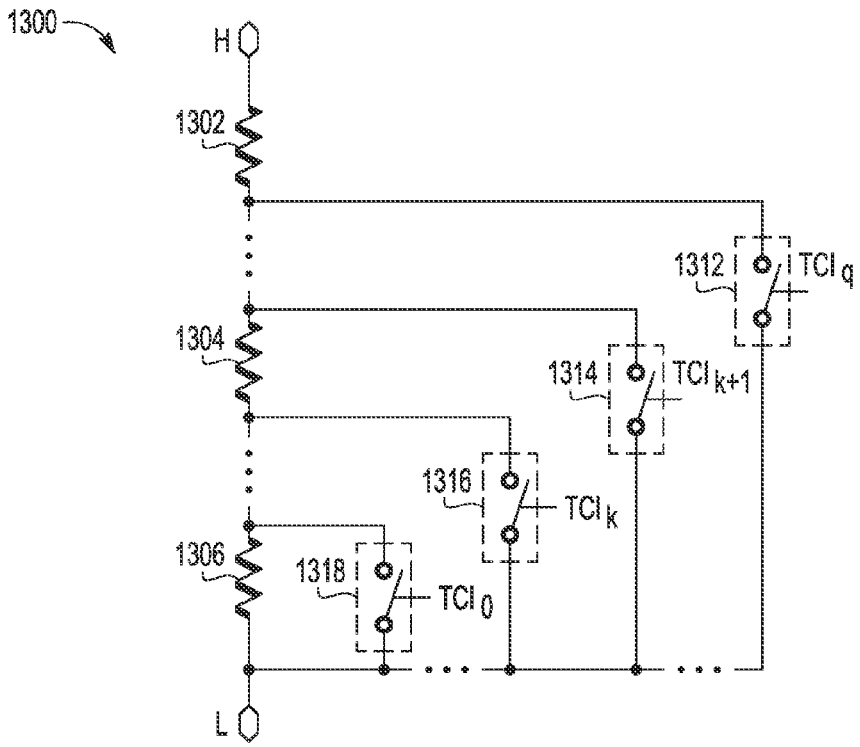
FIG. 13 is a schematic diagram of an embodiment of a trimming circuit (programmable resistive network) according to an embodiment of the current-mode voltage reference circuits of FIGS. 11 and 12.

FIG. 13 is a schematic diagram of an embodiment of a trimming circuit 1300, which may be used to replace one or both of resistors 1110 and 1118, according to an embodiment of the current-mode voltage reference circuit of FIG. 11, or to replace any of the resistors, including resistors 1208, 1210, and 1212 of the current-mode voltage reference circuit of FIG. 12. Trimming circuit 1300 includes a plurality of resistors 1302, 1304, and 1306 (and possibly other resistive elements in between, which are not represented in FIG. 13) connected in series between a first terminal (H) and a second terminal (L). Trimming circuit 1300 further includes an associated plurality of switches 1312, 1314, 1316, and 1318 (and possibly other switches in between, which are not represented in FIG. 12), where each switch has a first current electrode connected to the second terminal (L), a control electrode for receiving digital signals from control circuit 110, and a second current electrode connected to a node between two of the resistors.

In operation, each of the plurality of switches 1312, 1314, 1316, and 1318 is independently controllable based on digital signals from control circuit 110 for adjusting the resistance of the trimming circuit. Implementing the trimming circuit in place of resistor 1110 and also in place of resistor 1118 makes it possible to digitally adjust the resistance of the current-mode voltage reference circuit 102 to provide thermal compensation. Similarly, implementing the trimming circuit in place of resistor 1212, it is possible to trim the current-mode bandgap reference voltage by digitally adjusting the value of resistor 1212 and/or other resistors of circuit 1200.

To this point, programmability of the voltage reference circuit 102, the error amplifier 104, and the feedback circuit 108 have been discussed. However, LDO regulator circuit 100 also permits programming of the pass device 106. In a particular example, by implementing pass device 106 as a transistor network 1300 as depicted in FIG. 14, it is possible to adjust the DC performance and the transient response of programmable pass device 106.

Figure 14:
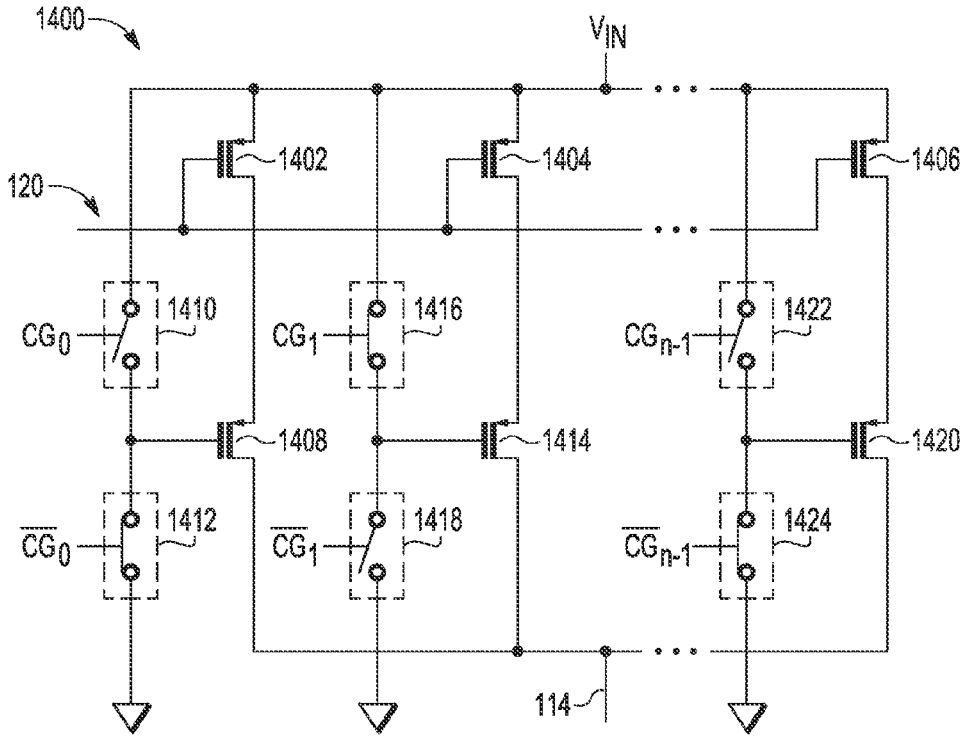
FIG. 14 is a schematic diagram of an embodiment of a programmable pass device according to an embodiment of the LDO regulator circuit of FIG. 1.

FIG. 14 is a schematic diagram of an embodiment of a transistor network 1400, which can be used to implement pass device 106 according to an embodiment of the LDO regulator circuit 102 of FIG. 1. Transistor network 1400 includes a plurality of PMOS transistors 1402, 1404, and 1406 having common source electrodes connected to a voltage terminal ($V_{IN}$) and common gate electrodes connected to the output 130 of the error amplifier 104. PMOS transistor 1402 includes a drain electrode connected to a source electrode of PMOS transistor 1408, which includes a gate electrode that is selectively connected to the voltage terminal ($V_{IN}$) through switch 1410 or to ground through switch 1412. Further, PMOS transistor 1408 includes a drain electrode connected to voltage output 114.

PMOS transistor 1404 includes a drain electrode connected to a source electrode of PMOS transistor 1414, which includes a gate electrode that is selectively connected to the voltage terminal ($V_{IN}$) through switch 1416 or to ground through switch 1418. PMOS transistor 1414 further includes a drain electrode connected to voltage output 114.

PMOS transistor 1406 includes a drain electrode connected to a source electrode of PMOS transistor 1420, which includes a gate electrode that is selectively connected to the voltage terminal ($V_{IN}$) through switch 1422 or to ground through switch 1424. PMOS transistor 1420 further includes a drain electrode connected to voltage output 114.

Thus, in the illustrated embodiment, programmable pass device 106 is designed with multiple modules (a first module represented by a current path including transistors 1402 and 1408, a second module represented by a current path including transistors 1404 and 1414, and a third module represented by a current path including transistors 1406 and 1420), which are connected in parallel. By selectively applying control signals to the switches 1410, 1412, 1416, 1418, 1422, and 1424, one or more of the current paths is disabled by disconnecting the signal path. Such control signals are provided by the control circuit 110 through the pass control signal bus 126. When the particular circuit application does not require large current loads, the transient response of the programmable pass device 102 can be improved by disabling one or more modules, thus reducing the parasitic capacitance at the output and altering the transient response of the pass device 106.

While the above-discussion has provided examples of the programmable voltage reference circuit 102, the programmable pass device 106, and the programmable feedback circuit 108, various possible implementations are contemplated for implementing the programmable error amplifier 104. One possible example is described below with respect to FIG. 15.

Figure 15:
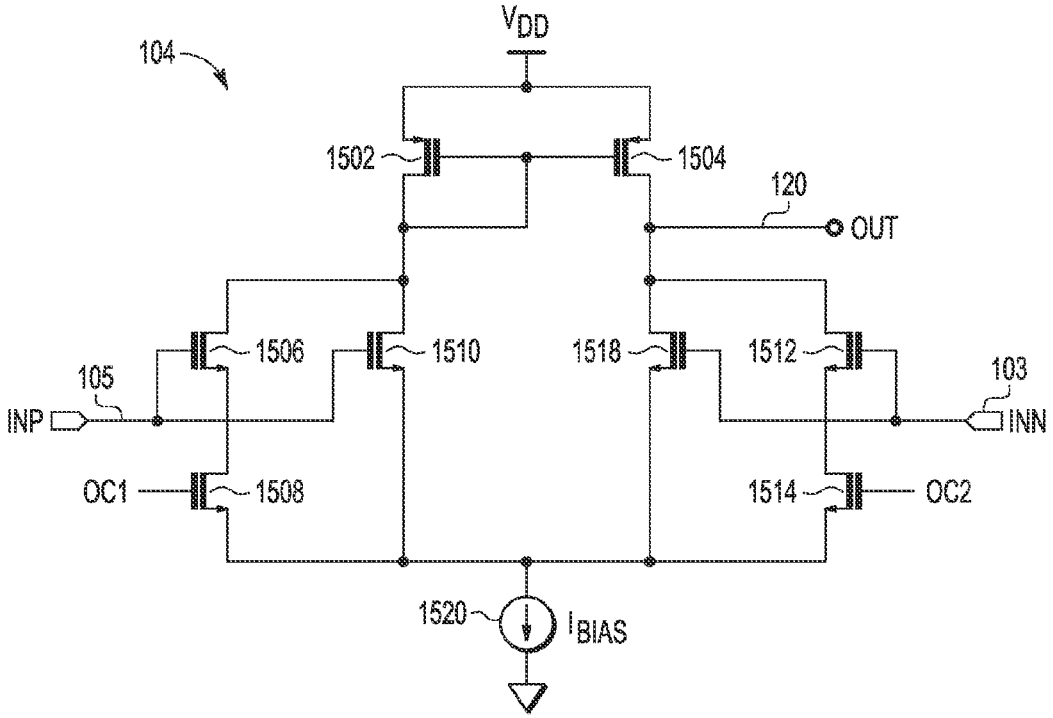
FIG. 15 is a schematic diagram of an embodiment of a programmable error amplifier according to an embodiment of the LDO regulator circuit of FIG. 1.

FIG. 15 is a schematic diagram of an embodiment of one of many possible implementations of a programmable error amplifier 104. Programmable error amplifier includes PMOS transistors 1502 and 1504 including source electrodes connected to a voltage supply terminal (VDD), gate electrodes connected at a common node. Transistor 1502 includes a drain electrode connected to its gate electrode and to drain electrodes of NMOS transistors 1506 and 1510, which have common gate electrodes connected to a positive input terminal (INP) connected to feedback output 105 to receive a feedback signal ($V_F$) from feedback circuit 108 depicted in FIG. 1. NMOS transistor 1506 further includes a source electrode connected to a drain electrode of NMOS transistor 1508, which includes a control electrode connected to a first control input (OC1) and a source electrode connected to a bias current source 1520. NMOS transistor 1510 includes a source electrode connected to bias current source 1520.

PMOS transistor 1504 includes a drain electrode connected to amplifier output 120 and to drain electrodes of NMOS transistors 1518 and 1512, which have gate electrodes connected to a negative input terminal (INN) connected to a voltage reference input 103 to receive a reference voltage ($V_{REF}$) from voltage reference circuit 102 depicted in FIG. 1. NMOS transistor 1518 includes a source electrode connected to bias current source 1520. NMOS transistor 1512 includes a source electrode connected to a drain electrode of NMOS transistor 1514, which includes a gate electrode connected to a second control input (OC2) and includes a source electrode connected to bias current source 1520. First and second control inputs (OC1 and OC2) are coupled to amplifier control input 124 to receive amplifier control signals from control circuit 110.

In operation, the reference voltage (VREF) on the negative input (INN) and the feedback voltage (VF) on the positive input (INP) activate transistors 1510 and 1518 to allow current flow to produce an amplifier output signal at amplifier output 120 that represents a difference between VREF and VF. Transistors 1508 and 1514 are responsive to control signals on amplifier control input 124 to enable or disable a current path through transistors 1506 and 1512, respectively, thereby adjusting current flow through one or both of the current paths. Thus, control circuit 110 uses control signals to selectively enable transistors 1506 and 1512 to contribute to the gain of the differential input, turning on or off transistors 1508 and 1514 as needed.

It should be appreciated that the LDO regulator circuitry, discussed above with respect to FIGS. 1-15, can be configured as part of a testing process implemented by a manufacturer where an input voltage is applied to an input of the LDO regulator and configuration data is provided to the LDO regulator through serial interface 112, which configuration data is stored in non-volatile memory, such as non-volatile register 204. The configuration data can be decoded using control logic 206 to produce control signals for configuring regulating functions of any or all of voltage reference 102, amplifier 104, pass device 106, and feedback circuit 108.

Further, serial interface 112 is accessible by a host system or control circuit to update or replace all or a portion of the configuration data at any time. In one embodiment, control logic 206 decodes the configuration data to produce control signals as soon as the configuration data has been received into the configuration register, or after being saved to non-volatile memory, and applies the control signals to any or all of voltage reference 102, amplifier 104, pass device 106, and feedback circuit 108 to adjust a regulating function (such as an output voltage level, a frequency parameter, a quiescent current limit, or other parameters of the output voltage) immediately. In another embodiment, control logic 206 decodes the configuration data at startup, and any changes to the configuration data are stored in non-volatile memory until a next start up event. In still another embodiment, control logic 206 decodes the configuration data in response to receiving a command through serial interface 112.

In conjunction with embodiments disclosed above with respect to FIGS. 1-15, a programmable LDO regulator 102 is disclosed that includes a programmable voltage reference circuit 104, a programmable error amplifier 104, a programmable pass device 106, and a programmable feedback circuit 108. Further, the programmable LDO regulator 102 includes a serial interface 112 and a control circuit 110, which make it possible to program the LDO regulator 102 multiple times to adjust a variety of parameters to control both DC and AC parameters of the output voltage ($V_{OUT}$). Settings for programmable voltage reference circuit 102, programmable error amplifier 104, programmable pass device 106, and programmable feedback circuit 108 may be stored in non-volatile register 204. Thus, the programmable LDO regulator is configurable to provide an output voltage having a desired voltage level and having desired DC and AC characteristics. Further, by providing a serial interface configurable to receive control information, including digital configuration data (such as a binary sequence), the LDO regulator circuit can be programmed digitally, multiple times, during fabrication and testing, and during operation.

Although the present invention has been described with reference to preferred embodiments, workers skilled in the art will recognize that changes may be made in form and detail without departing from the scope of the invention.

What is claimed is:

1. A low-dropout (LDO) regulator comprising:

a voltage reference circuit including a reference output for providing a reference voltage;

a pass device including an input terminal coupled to a voltage input, an output terminal to provide a voltage output, and a control input;

a feedback circuit including a feedback input terminal coupled to the output terminal and a feedback output terminal;

an error amplifier including a first error amplifier input coupled to the reference output, a second error amplifier input coupled to the feedback output terminal, and an error amplifier output coupled to the control input of the pass device; and a control circuit configurable to selectively and independently adjust a first performance parameter of the voltage reference circuit wherein the first performance parameter comprises an output voltage, a second performance parameter of the pass device, a third performance parameter of the feedback circuit, and a fourth performance parameter of the error amplifier wherein the fourth performance parameter comprises a gain to digitally program a regulating function at the voltage output.

2. The LDO regulator of claim 1, further comprising:

a serial interface adapted to couple to an external source and configured to send and receive data and control information to and from the external source.

3. The LDO regulator of claim 1, wherein the control circuit comprises:

a configuration register that stores configuration data related to the voltage reference circuit, the pass device, the feedback circuit, and the error amplifier; and combinational logic for decoding the configuration data into control signals that configure the voltage reference circuit, the pass device, the feedback circuit, and the error amplifier.

4. The LDO regulator of claim 1, wherein the control circuit comprises:

a non-volatile storage device configured to store configuration data related to the voltage reference circuit, the pass device, the feedback circuit, and the error amplifier.

5. The LDO regulator of claim 1, wherein the feedback circuit comprises at least one impedance network; and wherein the control circuit is configured to selectively adjust an impedance associated with the at least one impedance network.

6. The LDO regulator of claim 1, wherein the pass device comprises a transistor network; and wherein the control circuit enables devices within the transistor network of the pass device to adjust DC characteristics and a transient response.

7. The LDO regulator of claim 1, wherein the control circuit is configured to selectively enable an adaptive bias feature to control a quiescent current associated with the error amplifier.

8. The LDO regulator of claim 1, wherein the control circuit is configured to selectively configure a threshold level for over-current protection associated with the voltage output.

9. The LDO regulator of claim 1, wherein the error amplifier comprises:

a first transistor including a source coupled to a power supply terminal, a gate, and a drain coupled to the gate;

a second transistor including a source coupled to the power supply terminal, a gate coupled to the gate of the first transistor, and a drain coupled to the error amplifier output;

a third transistor including a drain coupled to the drain of the first transistor, a gate coupled to the feedback output terminal, and a source coupled to a bias current source;

a fourth transistor including a drain coupled to the drain of the second transistor, a gate coupled to the reference output, and a source coupled to the bias current source;

a fifth transistor including a drain coupled to the drain of the third transistor, a gate coupled to the feedback output terminal, and a source;

a sixth transistor including a drain coupled to the drain of the fourth transistor, a gate coupled to the reference output, and a source;

a first switch coupled between the source of the fifth transistor and the bias current source and including a control terminal coupled to the control circuit; and a second switch coupled between the source of the sixth transistor and the bias current source and including a control terminal coupled to the control circuit.

10. The LDO regulator of claim 1, wherein the voltage reference comprises:

a PMOS transistor including a first electrode coupled to the voltage input, a second electrode coupled to the reference output, and a control electrode;

a first resistive element including a first terminal coupled to the reference output and a second terminal;

a second resistive element including a first terminal coupled to the reference output and a second terminal;

an amplifier comprising a first amplifier input coupled to the second terminal of the first resistive element, a second amplifier input coupled to the second terminal of the second resistive element, and an amplifier output coupled to the control electrode of the PMOS transistor;

a third resistive element including a first terminal coupled to the first amplifier input and a second terminal;

a first diode connected device including a first terminal coupled to the second terminal of the third resistive element and a second terminal coupled to a power supply terminal; and a second diode-connected device including a first terminal coupled to the second amplifier input and a second terminal coupled to the power supply terminal;

wherein the control circuit is configurable to program a resistance associated with at least one of the first, second and third resistive elements to control a thermal coefficient or a nominal level of the reference voltage.

11. The LDO regulator of claim 1, wherein the voltage reference comprises:

first and second PMOS transistors, each of the first and second PMOS transistors including a first electrode coupled to the voltage input, a control electrode coupled to a common node, and a second electrode;

an amplifier including a positive input coupled to the second electrode of the first PMOS transistor, a negative input and an output coupled to the second electrode of the second PMOS transistor;

a first resistive element including a first terminal coupled to the positive input and to the second electrode of the first PMOS transistor and including a second terminal;

a second resistive element including a first terminal coupled to the second terminal of the first resistive element and a second terminal coupled to ground; and a third resistive element including a first terminal coupled to the output of the amplifier and a second terminal coupled to the first terminal of the second resistive element; and wherein the control circuit is configurable to program a resistance associated with at least one of the first, second and third resistive elements to control a nominal level of the reference voltage at the output of the amplifier.

12. A method of providing an output voltage using a programmable integrated circuit low-dropout (LDO) regulator, the method comprising:

receiving configuration data from a control circuit through a serial interface of the LDO regulator;

storing the configuration data in a non-volatile memory; and decoding the configuration data using control logic of a control circuit of the LDO regulator to produce control signals to independently configure a first performance parameter of a programmable reference circuit, a second performance parameter of a programmable error amplifier, a third performance parameter of a programmable pass device, and a fourth performance parameter of a programmable feedback circuit to produce the output voltage.

13. The method of claim 12, wherein the control signals comprise at least one first control signal, at least one second control signal, at least one third control signal, and at least one fourth control signal.

14. The method of claim 13, wherein after decoding the configuration data, the method further comprises:

receiving a voltage input signal at an input of the LDO regulator;

generating a reference voltage using the programmable reference circuit configured according to the at least one first control signal;

regulating the voltage input signal using the programmable pass device coupled to the input and configured according to the at least one second control signal to produce the output voltage at an output terminal;

sampling the output voltage using the programmable feedback circuit configured according to the at least one third control signal to produce a feedback voltage; and comparing the feedback voltage to the reference voltage using the programmable error amplifier configured according to the at least one fourth control signal to produce an error signal at an amplifier output of the error amplifier, the amplifier output coupled to the programmable pass device to adjust the output voltage.

15. The method of claim 12, further comprising:

receiving second configuration data through the serial interface;

storing the second configuration data in the non-volatile memory; and decoding the second configuration data using the control logic to produce second control signals to selectively adjust the first performance parameter of the programmable reference circuit, the second performance parameter of the programmable error amplifier, the third performance parameter of the programmable pass device, and the fourth performance parameter of the programmable feedback circuit to produce the output voltage.

16. A low-dropout (LDO) regulator comprising:

a voltage reference circuit having an output for providing a reference voltage;

an error amplifier having a first input for receiving the reference voltage, a second input for receiving a feedback voltage, and an output; and a pass device including a first terminal coupled to a voltage input, a second terminal to provide a voltage output to an output terminal, and a control terminal coupled to the output of the error amplifier;

a feedback circuit including an input coupled to the output terminal, and an output for providing the feedback voltage; and a control circuit for independently controlling the reference voltage based on first configuration data and a gain of the error amplifier based on second configuration data.

17. The LDO regulator of claim 16 wherein:

a non-volatile register for storing the first configuration data and the second configuration data.

18. The LDO regulator of claim 17 wherein:

the control circuit further controls the feedback voltage independently of the reference voltage.

19. The LDO regulator of claim 18 wherein:

the control circuit controls the feedback voltage based on third configuration data.

20. The LDO regulator of claim 16, wherein the control circuit comprises:

a configuration register that stores configuration data related to the voltage reference circuit, the error amplifier, the pass device, and the feedback circuit; and combinational logic for decoding the configuration data into control signals that configure the voltage reference circuit, the error amplifier, the pass device, and the feedback circuit.

21. The LDO regulator of claim 20, further comprising:

a serial interface circuit adapted to couple to an external source and configured to send and receive data and control information to and from the external source and communicate the data with the control circuit.

22. The LDO regulator of claim 21, wherein the control circuit further comprises:

control logic for receiving the first and second configuration data from the serial interface circuit, for selectively providing the first and second configuration data to the configuration register, and for selectively storing the first and second configuration data in a non-volatile register.

* * * * *